US009010579B2

(12) United States Patent
Baker et al.

(10) Patent No.: US 9,010,579 B2
(45) Date of Patent: Apr. 21, 2015

(54) MANIFOLD MODULE FOR BEVERAGE DISPENSING SYSTEM

(75) Inventors: Bret D. Baker, Vacaville, CA (US); Thomas R. Hecht, Winters, CA (US)

(73) Assignee: Automatic Bar Controls, Inc., Vacaville, CA (US)

( * ) Notice: Subject to any disclaimer, the term of this patent is extended or adjusted under 35 U.S.C. 154(b) by 0 days.

(21) Appl. No.: 13/216,172

(22) Filed: Aug. 23, 2011

(65) Prior Publication Data

US 2013/0048674 A1 Feb. 28, 2013

(51) Int. Cl.

| | |
|---|---|
| ***B67D 7/06*** | (2010.01) |
| ***B67D 7/74*** | (2010.01) |
| ***B67D 1/00*** | (2006.01) |

(52) U.S. Cl.

CPC ..... *B67D 1/0086* (2013.01); *B67D 2210/0006* (2013.01)

(58) Field of Classification Search

USPC ..... 222/129.1, 144.5, 484, 132, 145.1, 152, 222/481; 137/884, 15.05, 237, 238, 271

See application file for complete search history.

(56) References Cited

U.S. PATENT DOCUMENTS

| | | | | | |
|---|---|---|---|---|---|
| 3,664,552 | A * | 5/1972 | Carse | 22/144.5 |
| 4,619,378 | A * | 10/1986 | de Man | 222/144.5 |
| 4,986,449 | A * | 1/1991 | Valiyee et al. | 222/144.5 |
| 5,042,692 | A * | 8/1991 | Valiyee et al. | 222/144.5 |
| 5,918,616 | A * | 7/1999 | Sanfilippo et al. | 137/1 |
| 6,698,621 | B2 * | 3/2004 | Landers et al. | 222/129.1 |
| 7,028,864 | B2 * | 4/2006 | McCann et al. | 222/144.5 |
| 2007/0114244 | A1 * | 5/2007 | Gatipon et al. | 222/129.1 |
| 2009/0107559 | A1 * | 4/2009 | Edwards et al. | 137/15.21 |
| 2009/0283543 | A1 * | 11/2009 | Schroeder et al. | 222/144.5 |
| 2011/0042415 | A1 * | 2/2011 | Santy et al. | 222/144.5 |

* cited by examiner

*Primary Examiner* — Paul R Durand
*Assistant Examiner* — Vishal Pancholi
(74) *Attorney, Agent, or Firm* — Kilpatrick Townsend & Stockton LLP

(57) ABSTRACT

A beverage dispensing system includes a beverage dispensing head for dispensing beverages from at least one pressurized beverage source, and at least one beverage tube, with a first end that is fluidly connected to the beverage dispensing head and a second end. A manifold module for use in this system includes at least one flow control module configured for attachment to and fluid communication with the beverage source, and a beverage redirecting apparatus configured to be attached between the flow control module and the second end of the beverage tube. The beverage redirecting apparatus includes at least one fluid inlet in fluid communication with the flow control module and at least one fluid outlet in fluid communication with the second end of the beverage tube. The beverage redirecting apparatus is configured such that a direction of fluid flow is altered between the inlet and the outlet.

21 Claims, 8 Drawing Sheets

-- PRIOR ART --

-- PRIOR ART --

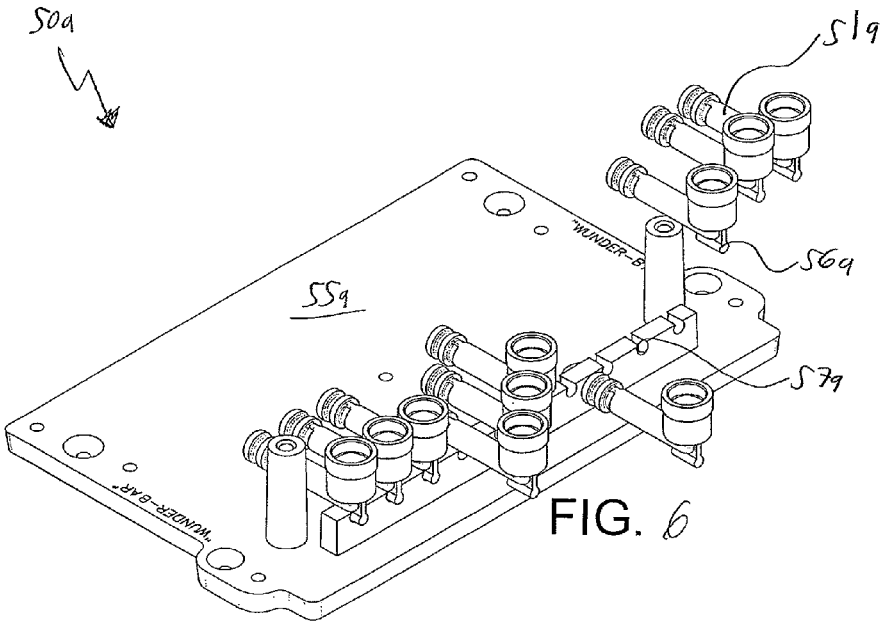
FIG. 6
FIG. 7A
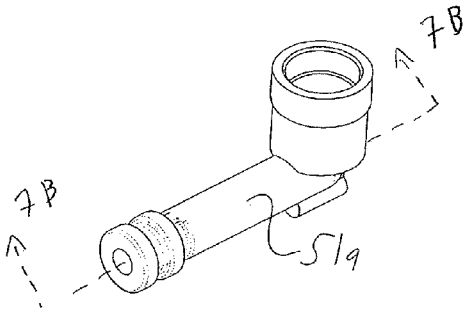
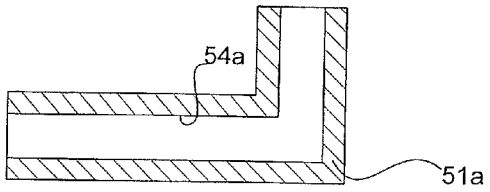
FIG. 7B

MANIFOLD MODULE FOR BEVERAGE DISPENSING SYSTEM

BACKGROUND OF THE INVENTION

This invention relates to a manifold module for a beverage dispensing system, and more particularly, for a beverage dispensing system in which several different beverages are dispensed from a single beverage dispensing head by pressing an appropriate button.

Hand-held beverage dispensers which provide the operator with the ability to dispense a number of different beverages by merely pressing an appropriate button have become quite popular. One example of such a dispenser is shown in U.S. Pat. No. 5,042,692 to Valiyee et al, assigned to the assignee of the instant application, the contents of which are hereby incorporated by reference.

Such a system includes a beverage dispensing head with a number of buttons, each corresponding to a different beverage. The head is fed by a number of beverage tubes, usually encased in a flexible metal sheath (or "flex hose") that terminates in a tube collector housing that connects the head to a flow control module assembly mounted to the underside of the bar, or to another fixed location. Inside the tube collector, the flex hose terminates, and the beverage tubes are spread out from one another through the tube collector to terminate at the other side of the tube collector at specific, splayed out locations, where they are inserted into the flow control module assembly. At the other side of the flow control module assembly is a second set of tubes, which connect the flow control module assembly to containers of soda water, soft drink syrups, and the like, so that each beverage tube is indirectly fed by a container. Both sets of tubes are removable from the flow control module assembly for cleaning and repair of various parts, and for replacement of empty beverage containers.

This system is advantageous in that the beverage containers, the flow control module assembly, the beverage tubes, the secondary tubes, and the like, are all safely stowed under the bar and out of the way, with only the beverage dispensing head and flex hose visible. However, in bars and restaurants with narrow bars, there may not be room for the secondary tubes, the flow control module assembly, and the tube collector that encases the beverage tubes to fit within the width of the bar.

BRIEF SUMMARY OF THE INVENTION

Exemplary manifold modules described herein address these and other problems by providing a beverage redirecting apparatus between the flow control module assembly and the tube collector that encases the beverage tubes. The secondary tubes and the flow control module assembly are thus disposed at an angle with respect to the tube collector that encases the beverage tubes, for example 90°. Thus, in some embodiments, the tube collector is mounted horizontally underneath the bar, and the flow control module assembly is mounted vertically, saving precious horizontal space in narrow bars.

In more detail, a beverage dispensing system includes a beverage dispensing head for dispensing beverages from at least one pressurized beverage source, and at least one beverage tube, with a first end that is fluidly connected to the beverage dispensing head and a second end. A manifold module for use in this system includes at least one flow control module configured for attachment to and fluid communication with the beverage source, and a beverage redirecting apparatus configured to be attached between the flow control module and the second end of the beverage tube. The beverage redirecting apparatus includes at least one fluid inlet in fluid communication with the flow control module and at least one fluid outlet in fluid communication with the second end of the beverage tube. The beverage redirecting apparatus is configured such that a direction of fluid flow is altered between the inlet and the outlet.

The system may include multiple beverage tubes and the manifold module may include a corresponding number of flow control modules. The manifold module may further include multiple beverage redirecting apparatuses, where each apparatus has exactly one fluid inlet in fluid communication with exactly one flow control module, and exactly one fluid outlet in fluid communication with exactly one beverage tube. The fluid inlet may be directly connected to the flow control module. The fluid outlet may be directly connected to the beverage tube. The apparatuses may be injection-molded, and may be made of any material suitable for contact with beverages. An exemplary material is polycarbonate.

Alternatively, a single beverage redirecting apparatus may have multiple inlets and a corresponding number of outlets, where each inlet is in fluid communication with exactly one flow control module and each outlet is in fluid communication with exactly one beverage tube. Each fluid outlet may be directly connected to a corresponding beverage tube. The module may also include a connector removably attached between each inlet of the beverage redirecting apparatus and a corresponding flow control module. The apparatus may be machined, and may be made of any material suitable for beverage contact. An exemplary material is Acetal.

The beverage redirecting apparatus may alter the direction of fluid flow by more than about 45° between the inlet and the outlet, such as by about 90°.

Another exemplary embodiment provides a beverage dispensing system which includes a manifold module such as the one described above.

BRIEF DESCRIPTION OF THE DRAWINGS

Exemplary embodiments will be described in more detail with reference to the accompanying drawings, in which:

FIG. 6 is a partially exploded view of an exemplary beverage redirecting apparatus assembly.

FIG. 7A is a perspective view of a second exemplary beverage redirecting apparatus.

FIG. 7B is a cross-sectional view of the beverage redirecting apparatus of FIG. 7A.

DETAILED DESCRIPTION OF EXEMPLARY EMBODIMENTS

Figure 1:
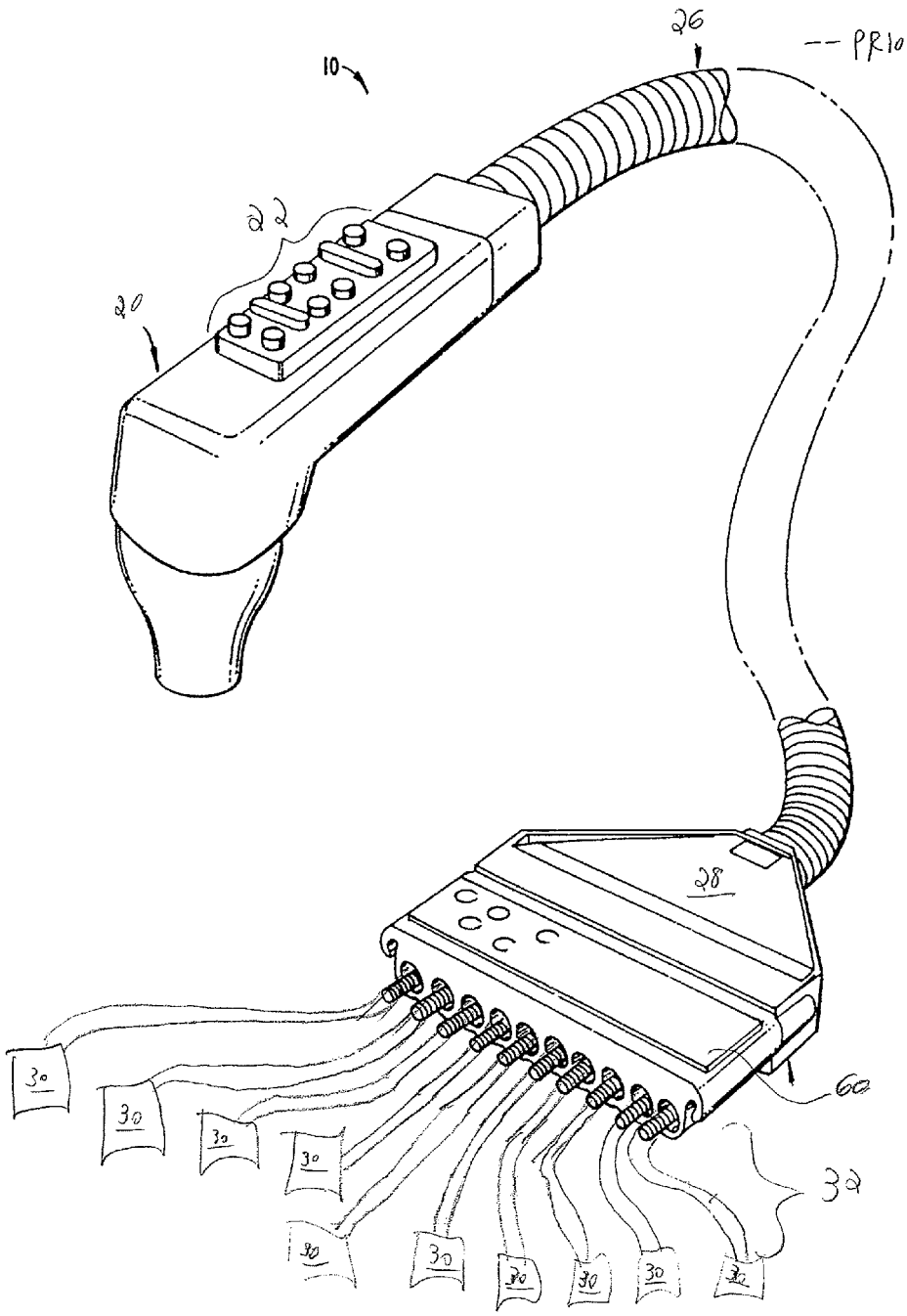
FIG. 1 is a partially perspective, partially schematic view of a known beverage dispensing system.

FIG. 1 illustrates a known beverage dispensing system 10, which generally includes a beverage dispensing head 20 that dispenses beverages from beverage sources 30. The beverage sources contain a variety of beverages that are routed through the system 10 through a variety of tubes and fluid channels (described in detail later), to eventually be dispensed out of the head 20 at the press of a button 22. Examples of beverages include soda water, plain water, flavoring syrups, juices, wine, and liquor. The beverages may be mixed in the beverage dispensing head (e.g. soda water and a flavoring syrup can be mixed to create a soft drink), or may be dispensed individually. The beverages are dispensed by a user pressing a button 22 on the beverage dispensing head 20 in a manner that is generally known in the art. In more detail, the two larger buttons 22 may correspond to soda water and plain water, respectively, and the eight smaller buttons may correspond to soft drinks.

Figure 2:
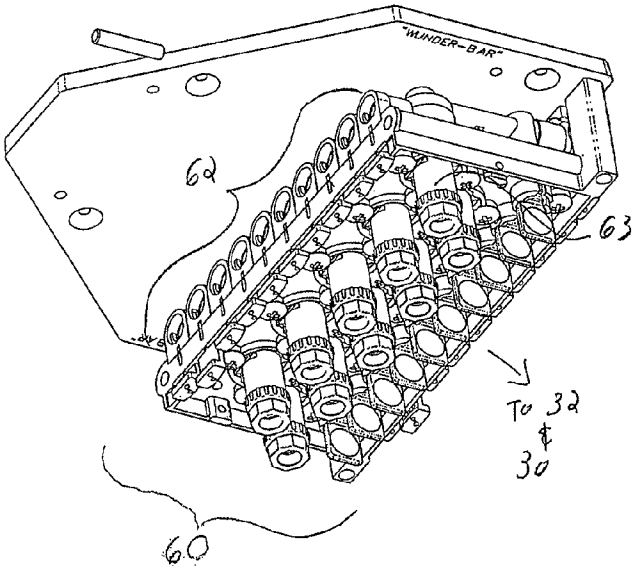
FIG. 2 is a perspective view of a known flow control module assembly connected to a tube collector, with the tube collector shown in exploded perspective.
Figure 2:
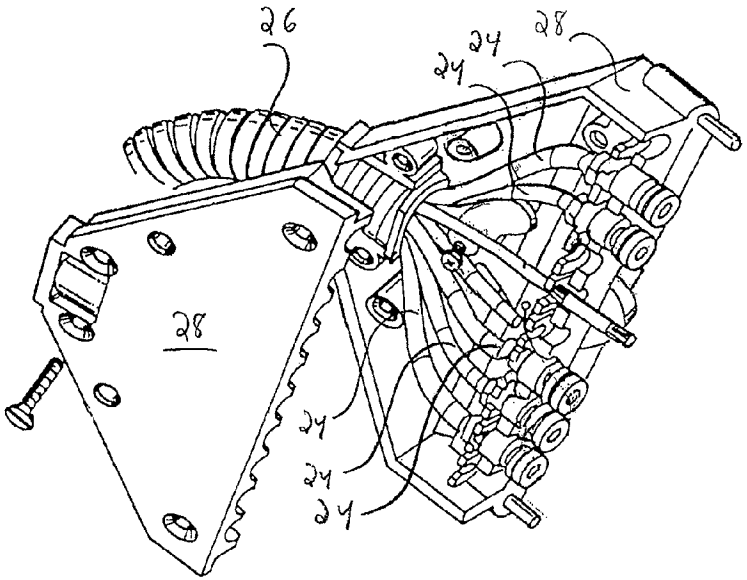

In still more detail, referring also to FIG. 2, the beverage dispensing head 20 dispenses beverages from several individual beverage tubes 24, which emerge from the head 20 and are encased in a flex hose 26. The beverage tubes 24 emerge from the flex hose 26 into a tube collector 28, at the end of which they are removably connected to fluid outlets of a flow control module assembly 60, described in detail later. Fluid inlets of the flow control module assembly are removably connected to secondary tubes 32, which are connected to the beverage containers 30. Thus, in operation, fluid flows from the beverage containers 30, through the secondary tubes 32, through the flow control module assembly 60, through the beverage tubes 24, and to the beverage dispensing head 20, where it is dispensed.

Referring back to FIG. 1, in general, the secondary tubes 32 are sufficiently long to connect the flow control module assembly 60 to the relatively remotely located beverage containers 30, whose precise location, and thus distance from the flow control module assembly 60, depends on the particular setup of each bar or restaurant. For example, in some situations, the beverage sources 30 are stored in a remotely located refrigerator or kegerator. In some situations, the secondary tubes 32 are made in whole or in part of thermally conductive material such as copper, and routed through a refrigerator or an ice trough, to chill the beverages as they are being dispensed. In other words, in most cases, the beverage sources are located relatively remotely to the rest of the system, in any location that is out of sight of customers and out of the way of bar or restaurant staff.

The flow control module assembly 60 is composed mainly of individual flow control modules 62. The fluid is routed from the secondary tubes 32 to the beverage tubes 24 through the flow control modules 62. Each flow control module 62 is operatively associated with a flow regulating or metering valve 63 in a manner that is generally known in the art. Therefore, the length of the flow control module assembly 60 in the direction of fluid flow is defined by the physical characteristics of the valves, and is generally around three inches.

In practice, in most situations, the tube collector 28 and flow control module assembly 60 are mounted to the underside of a bar at a location near where the beverage dispensing head 20 is intended to be used, with just the beverage dispensing head 20 and flex hose 26 visible. The tube collector 28 has a typical depth of around four inches (which is necessary for the at least somewhat rigid tubes to be routed through it), and the flow control module assembly 60 has a typical depth of three inches. In typical prior art applications, the secondary tubes 32 enter the flow control module assembly 60 via straight connections, and require a minimum of around six inches of clearance between the assembly 60 and the back wall behind the underside of the bar to which the complete assembly is mounted. Thus, it will be readily appreciated that in some narrower bars, it would be difficult to fit the tube collector 28, the flow control module assembly 60, and the straight portions of the secondary tubes 32, all within the depth of the bar.

Therefore, turning to FIGS. 3-7, embodiments described herein include one or more beverage redirecting apparatus 51, 51*a*, which connects the tube collector 28 to the flow control module assembly 60 at an angle, such as, for example and without limitation, 90°. Thus, in some embodiments, the flow control module assembly 60 can be mounted vertically, up the back wall behind the underside of the bar, with the tube collector 28 mounted horizontally to the underside of the bar, so that the entire system 10 (excluding the flex hose 26 and beverage dispensing head 20) fits neatly underneath the bar.

Figure 3A:
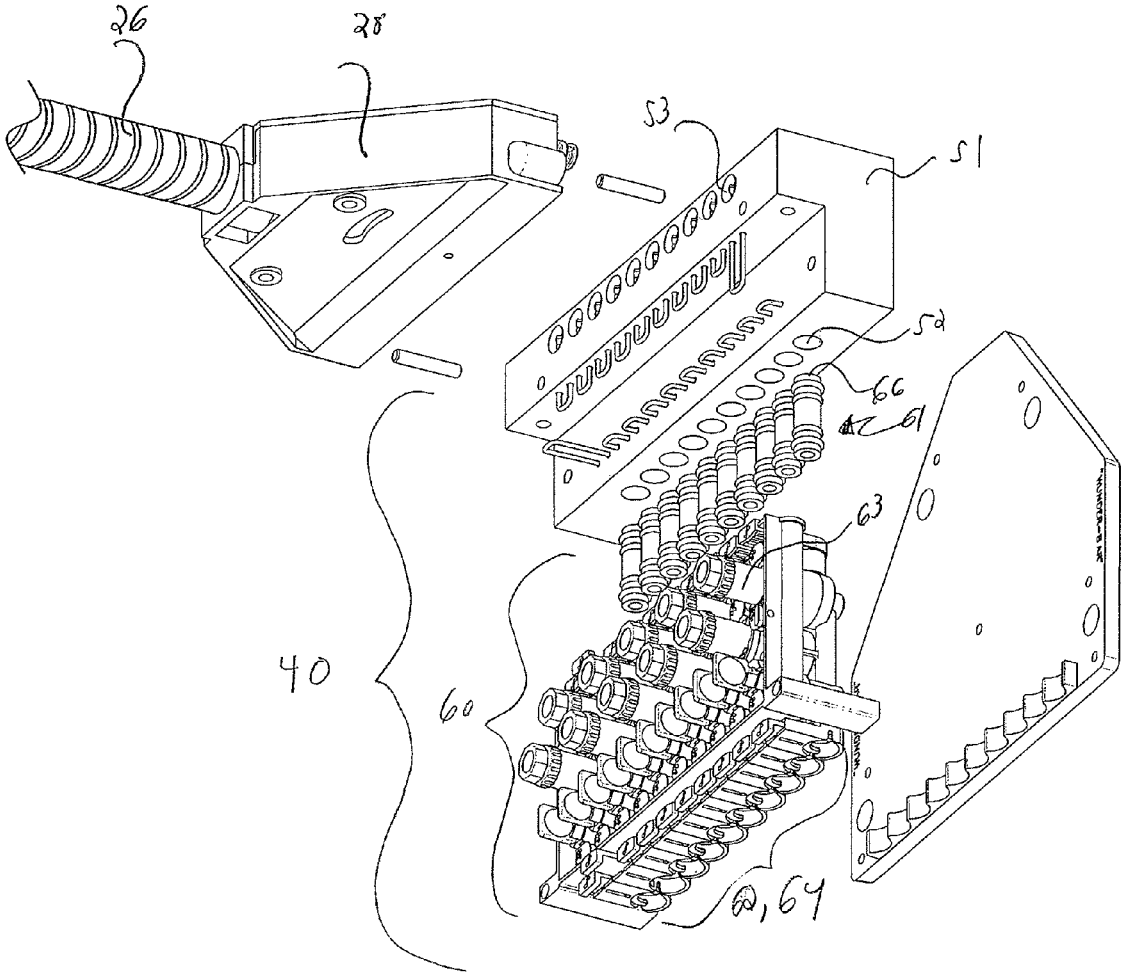
FIG. 3A is perspective view of a first exemplary manifold module connected to a tube collector, with the manifold module shown in exploded perspective.
Figure 3B:
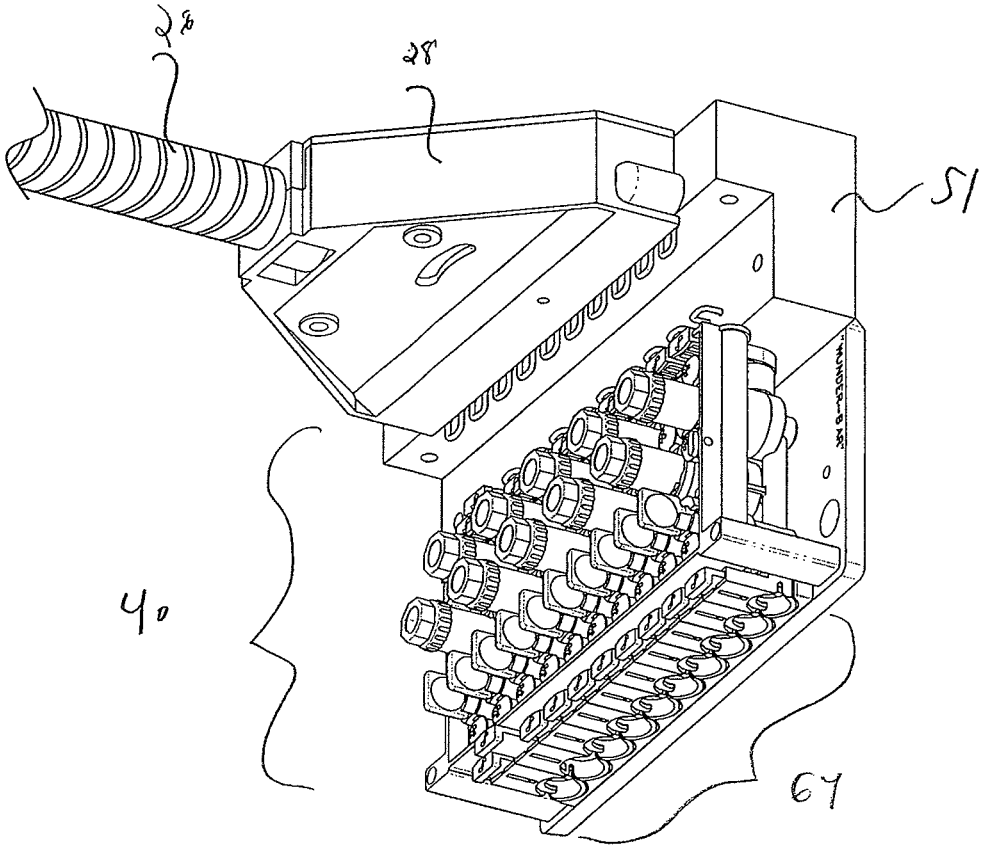
FIG. 3B is an assembled perspective view of the first exemplary manifold module connected to a tube collector.

A first exemplary manifold module 40 is shown in FIGS. 3A-3B, and includes a flow control module assembly 60 and a beverage redirecting apparatus 51, which may be permanently or removably attached to one another, such as via connectors 61 of the flow control module assembly 60. The secondary tubes 32 (not shown in FIGS. 3A-3B) are removably connected to the flow control module assembly 60 at its input 64, and the beverage tubes 24 (hidden by the tube collector 28 in FIGS. 3A-3B) are removably connected to the beverage redirecting apparatus 51 at its output 53.

In practice, the exemplary manifold module 40 of FIGS. 3A and 3B would be mounted underneath a bar or a counter, out of sight of customers, and out of the way of staff. The manifold module 40 is removably connected to the secondary tubes 32 at one end 64, and to the tube collector 28 at the other end 53. This removability allows empty beverage sources 30 to be swapped out for full ones, and also allows removal of the beverage sources 30 and tube collector 28 for cleaning and repair. In this regard, the manifold module 40 serves essentially as a docking station for the beverage tubes 24 and secondary tubes 32, to provide a fluid connection between the beverage sources 30 on one end and the beverage dispensing head 20 on the other, while keeping the various tubes tucked out of the way under the bar.

In more detail, in the embodiment illustrated in FIGS. 3A and 3B, the flow control module assembly 60 includes a number of flow control modules 62: ten in FIG. 3A, but any number is possible. It should be appreciated that the number of flow control modules 62 should advantageously be identical to the number of beverages (or beverage components, such as syrups) that are being used, but in some applications, some of the flow control modules 62 may not be connected to beverage sources 30. Each flow control module 62 is configured to be connected to one of the beverage sources 30 via one of the secondary tubes 32 (not shown in FIGS. 3A and 3B) attached to ends 64 of the flow control modules 62. The other ends 66 of the flow control modules 62 are connected to the beverage redirecting apparatus 51 at fluid inlets 52 thereof. Each flow control module 62 is operatively associated with a flow regulating or metering valve 63.

Fluid outlets 53 of the beverage redirecting apparatus 51 are connected to the beverage tubes 24 (blocked by the tube collector 28 in FIGS. 3A and 3B). Thus a fluid flow path of FIGS. 3A and 3B would be from a beverage source 30, through a secondary tube 32, through one of the flow control modules 62, through a connector 61, through the beverage redirecting apparatus 51, through a beverage tube 24, and out through the beverage dispensing head 20.

Figure 4A:
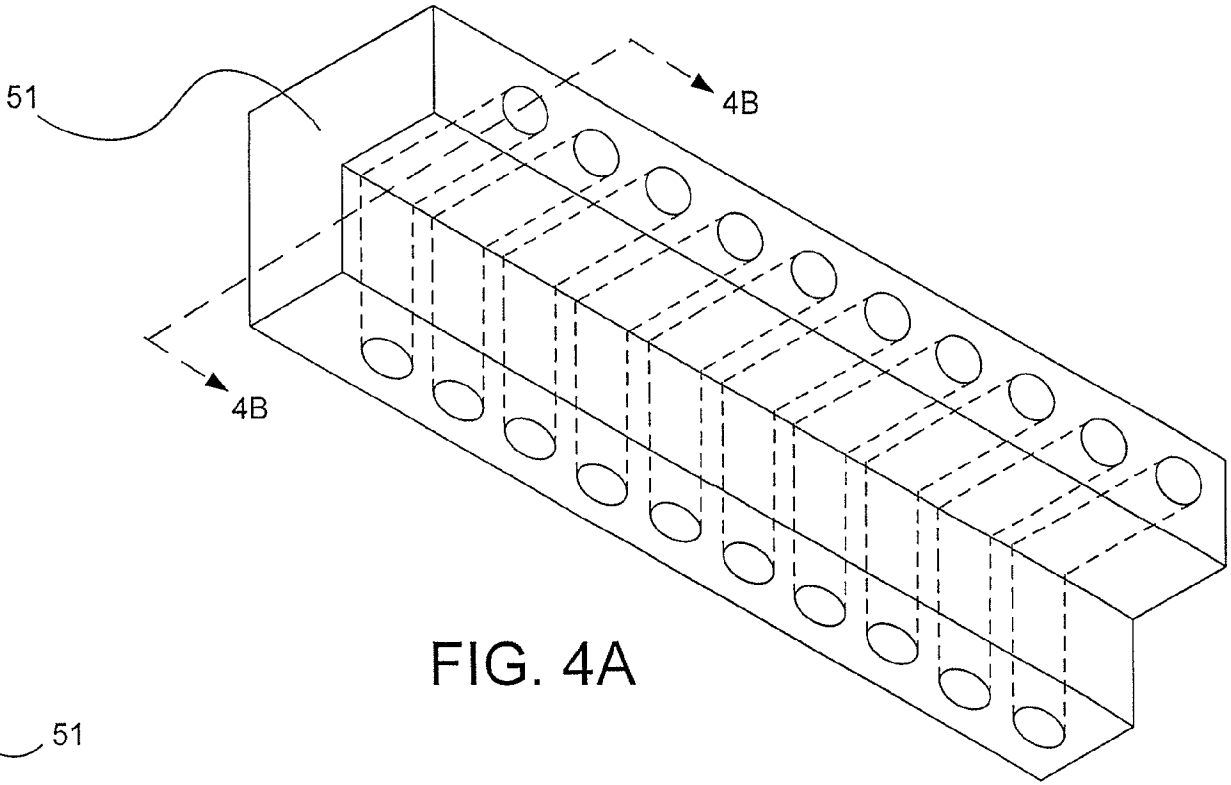
FIG. 4A is a perspective view of a first exemplary beverage redirecting apparatus, with fluid channels shown in dotted lines.
Figure 4B:
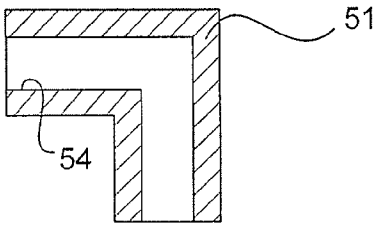
FIG. 4B is a cross-sectional view of the beverage redirecting apparatus of FIG. 4A.

Referring also to FIGS. 4A-4B, the beverage redirecting apparatus 51 of this first exemplary embodiment generally takes the form of a block of any material suitable for beverage contact, for example, acetal, with a generally L-shaped cross-section, and several fluid passageways 54 defined therein. In the embodiment illustrated in FIGS. 3A-4B, the beverage redirecting apparatus 51 has ten fluid passageways 54 defined therein, and the flow control module is configured to connect to ten secondary tubes 32 from ten beverage containers 30. Though not readily seen in these Figures, it is inherent that the tube collector 28 shown in these Figures houses ten beverage tubes 24, each of which removably connects to one of the fluid passageways 54 of the beverage redirecting apparatus 51.

It should be understood, however, that the manifold module 40 is not limited to such an arrangement. For example, ten-, twelve-, and fourteen-button beverage dispensing heads 20 are all commercially available and used in different applications. These heads would of course be used with ten, twelve, and fourteen beverage sources, respectively. Any number of beverage tubes 24, secondary tubes 32, and fluid passageways 54 of the beverage redirecting apparatus 51 is within the scope of the claims.

Furthermore, the invention is not limited to any particular number of beverage redirecting apparatuses. The single integral beverage redirecting apparatus of FIGS. 3A-4B may actually be two modular beverage redirecting apparatus, each with, for example, five fluid passageways. Any number of beverage redirecting apparatuses is within the scope of the claims.

The fluid channels of the beverage redirecting apparatus are shown at reference numeral 54 in FIGS. 4A and 4B. As shown therein, the fluid channels 54 may be generally L-shaped. This configuration makes maximal use of the space, and its simplicity also provides ease of manufacture: the exemplary beverage redirecting apparatus 51 of FIGS. 4A and 4B can easily be machined using standard tools. However, the invention is not limited to any particular shape of the beverage redirecting apparatus 51 or fluid channels 54. In some embodiments, for example where improved fluid flow characteristics are a concern, the fluid channels 54 may have a smoother curve. In some embodiments, the fluid channels 54 may redirect the fluid by an angle other than 90°.

It will be appreciated that in the embodiment illustrated in FIGS. 3A and 3B, the tube collector 28 is generally oriented perpendicular to the flow control module assembly 60, which helps save valuable horizontal space in narrower bars. In other words, the tube collector 28 is mounted underneath the bar, generally horizontal, parallel to the bar's surface, but the flow control module assembly 60 extends generally vertically underneath the bar, which allows these two components to fit in narrower bars that otherwise would not have the horizontal space.

Figure 5A:
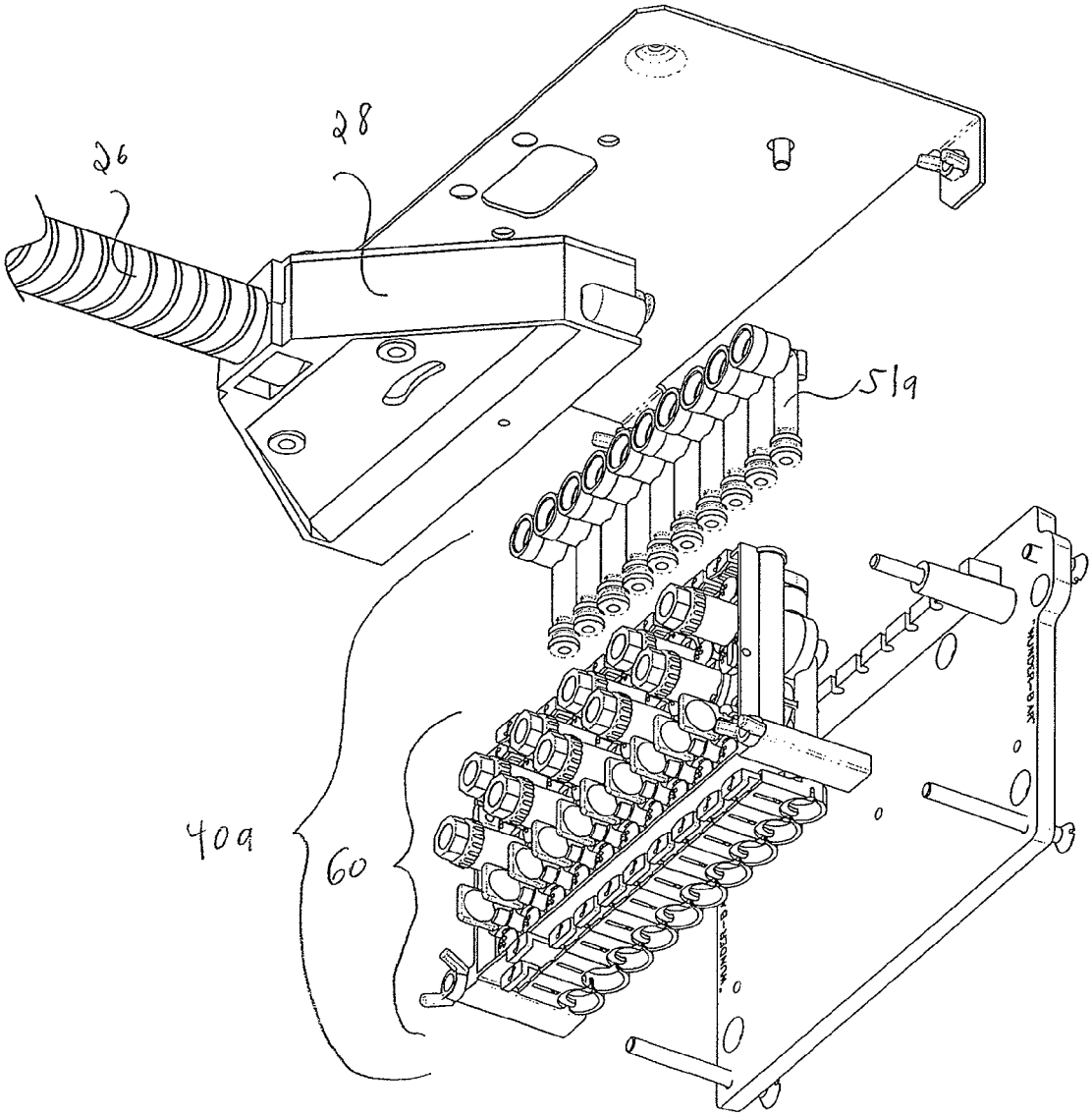
FIGS. 5A and 5B are views similar to those of 3A and 3B, but showing a second exemplary manifold module.
Figure 5B:
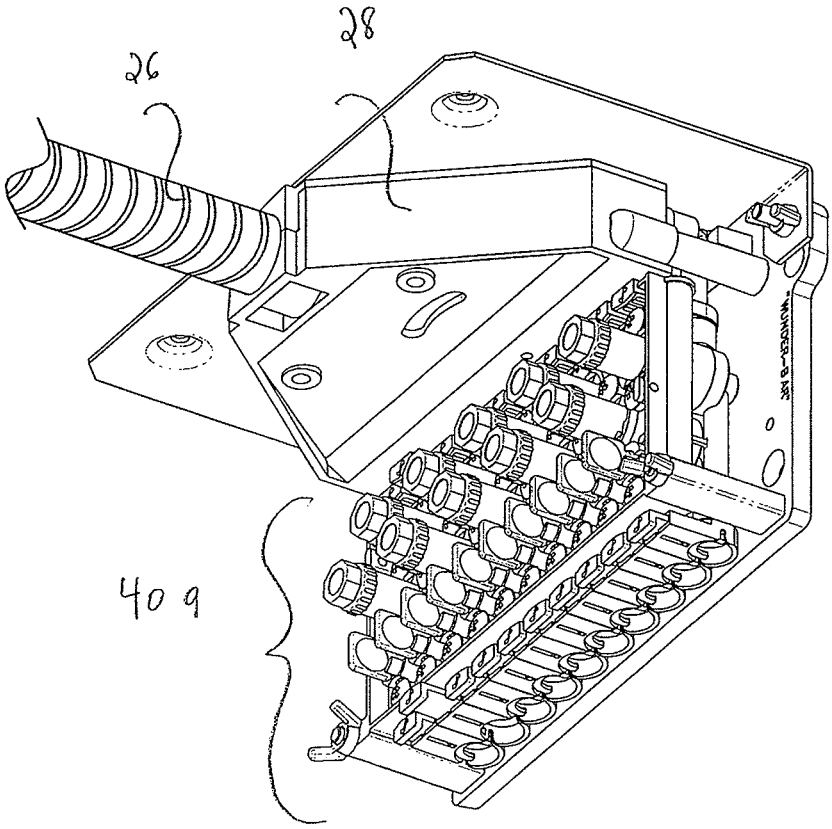

A second exemplary manifold module 40*a* is shown in FIGS. 5A-5B. Elements that are similar to those described above with reference to the first exemplary embodiment are given like reference numerals, and redundant descriptions will be omitted. The second exemplary manifold module 40*a* of FIGS. 5A-5B includes a flow control module assembly 60 and several beverage redirecting apparatuses 51*a*. In the illustrated embodiment, ten separate beverage redirecting apparatuses 51*a* are provided, each with only one fluid passageway 54*a*. The number of beverage redirecting apparatuses 51*a* used may be identical to the number of beverage tubes 24 and secondary tubes 32. The flow control module assembly 60 and beverage redirecting apparatuses 51*a* may be permanently or removably attached to one another. The secondary tubes 32 (not shown in FIGS. 5A-5B) are removably connected to the flow control module assembly 60, and the beverage tubes 24 (hidden by the tube collector 28 in FIGS. 5A-5B) are removably connected to the beverage redirecting apparatuses 51*a*.

Thus a fluid flow path of FIGS. 5A and 5B would be from a beverage source 30, through a secondary tube 32, through one of the flow control modules 62, through one of the beverage redirecting apparatus 51*a*, through a beverage tube 24, and out through the beverage dispensing head 20.

FIG. 6 illustrates an exemplary beverage redirecting apparatus assembly 50*a*, in which the several beverage redirecting apparatuses 51*a* are held in place by a base plate 55*a*, such as with protrusions 56*a* of the beverage redirecting apparatuses 51*a* being inserted into grooves 57*a* on the base plate 55*a*.

Referring also to FIG. 7A-7B, the beverage redirecting apparatuses 51*a* of this second exemplary embodiment generally take the form of L-shaped tubes, made of any material suitable for beverage contact, for example, polycarbonate, each with only one fluid passageway 54*a* defined therein. In the embodiment illustrated in FIGS. 5A, 5B, and 6, the number of beverage redirecting apparatuses 51*a* may be identical to the number of beverage sources 30, for example, ten.

The fluid channels of the beverage redirecting apparatuses are shown at reference numeral 54*a* in FIGS. 7A and 7B. As shown therein, the beverage redirecting apparatuses 51*a* may be generally L-shaped tubes with generally L-shaped fluid channels 54*a*. This configuration makes maximal use of the space, and its simplicity also provides ease of manufacture: the exemplary beverage redirecting apparatuses 51*a* of FIGS. 7A and 7B can easily be injection molded with a minimal amount of material. However, the invention is not limited to any particular shape of the beverage redirecting apparatuses 51*a* or fluid channels 54*a*. In some embodiments, for example where improved fluid flow characteristics are a concern, the fluid channels 54*a* may have a smoother curve. In some embodiments, the fluid channels 54*a* may redirect the fluid by an angle other than 90°.

It will be appreciated that, similar to in the first exemplary embodiment, in the embodiment illustrated in FIGS. 5A and 5B, the tube collector 28 is generally oriented perpendicular to the flow control module assembly 60, which helps save valuable horizontal space in narrower bars. The tube collector 28 is mounted underneath the bar, generally horizontal, parallel to the bar's surface, but the flow control module assembly 60 extends generally vertically underneath the bar, which allows them both to fit in narrower bars that otherwise would not have the horizontal space.

When used as adapters, both exemplary embodiments of the apparatus(es) allow for modification of an existing system to one with a redirecting apparatus(es) to take advantage of its/their space saving function.

As will be understood by those skilled in the art, the present invention may be embodied in other specific forms without departing from the essential characteristics thereof. Many other embodiments are possible without deviating from the spirit and scope of the invention. These other embodiments are intended to be included within the scope of the present invention, which is set forth in the following claims.

What is claimed is:

1. A kit for use in a beverage dispensing system, the kit comprising disassembled component parts to be installed at a beverage dispensing venue, the venue comprising a pre-existing countertop having a depth, the component parts of the kit comprising:

a handheld beverage dispensing head, configured and dimensioned to be held in a single hand of a user and further configured to receive user input from the single hand and to dispense at least one beverage from at least one pressurized beverage source in response to the input;

at least one beverage tube, comprising a downstream end configured to be fluidly connected to the beverage dispensing head and an upstream end;

a tube collector, configured to house an upstream portion of the beverage tube therein, the tube collector having a tube collector length in a beverage flow direction;

at least one flow control module having a flow control module length in the beverage flow direction;

at least one secondary tube, comprising an upstream end configured for attachment to and fluid communication with the beverage source, a downstream end configured for attachment to and fluid communication with the flow control module, and a substantially straight portion near the downstream end thereof defined by a rigidity of a material of the tube, the straight portion having a straight portion length; and a beverage redirecting apparatus configured to be disposed between the flow control module and the upstream end of the beverage tube, comprising at least one fluid inlet configured to be in fluid communication with the flow control module and at least one fluid outlet configured to be in fluid communication with the upstream end of the beverage tube, wherein the beverage redirecting apparatus is configured such that a first direction of fluid flow at the inlet is different from a second direction of fluid flow at the outlet;

the kit being configured such that:

when the tube collector length plus the flow control module length plus the straight portion length is less than or equal to the countertop depth, the beverage redirecting apparatus is not included in the beverage dispensing system, such that the beverage flows from the pressurized beverage source through the secondary tube, then through the flow control module, then directly into the beverage tube, and is then dispensed from the beverage dispensing head, wherein the tube collector, the flow control module, and the straight portion are mounted to an underside of the countertop to thereby extend along the countertop depth; and when the tube collector length plus the flow control module length plus the straight portion length is greater than the countertop depth, the beverage redirecting apparatus is attached between the flow control module and the upstream end of the beverage tube, such that the beverage flows from the pressurized beverage source through the secondary tube, then through the flow control module, then through the beverage redirecting apparatus, then into the beverage tube, and is then dispensed from the beverage dispensing head, wherein the tube collector and the beverage redirecting apparatus are mounted to the underside of the countertop to thereby extend along the countertop depth, and the flow control module and the straight portion are not mounted to the underside of the countertop extending along the countertop depth.

2. The kit of claim 1, wherein the system comprises a plurality of beverage tubes and the beverage redirecting apparatus comprises a corresponding number of fluid outlets.

3. The kit of claim 2, comprising a plurality of beverage redirecting apparatuses, wherein each apparatus comprises exactly one fluid inlet configured to be in fluid communication with exactly one beverage source, and exactly one fluid outlet configured to be in fluid communication with exactly one beverage tube.

4. The kit of claim 1, comprising a plurality of beverage redirecting apparatuses, wherein each apparatus comprises exactly one fluid inlet configured to be directly connected to and in fluid communication with exactly one flow control module, and exactly one fluid outlet configured to be in fluid communication with exactly one beverage tube.

5. The kit of claim 3, wherein the fluid outlet is configured to be directly connected to the beverage tube.

6. The kit of claim 3, wherein the apparatuses are injection-molded.

7. The kit of claim 3, wherein the apparatuses comprise material suitable for beverage contact.

8. The kit of claim 7, wherein the apparatuses comprise polycarbonate.

9. The kit of claim 2, wherein the beverage redirecting apparatus comprises a plurality of inlets and a corresponding number of outlets, wherein each inlet is configured to be in fluid communication with exactly one beverage source and each outlet is configured to be in fluid communication with exactly one beverage tube.

10. The kit of claim 9, wherein each fluid outlet is configured to be directly connected to a corresponding beverage tube.

11. The kit of claim 1, comprising a plurality of beverage tubes and a corresponding number of flow control modules, further comprising a connector configured to be removably attached between each inlet of the beverage redirecting apparatus and a corresponding flow control module.

12. The kit of claim 9, wherein the apparatus is machined.

13. The kit of claim 9, wherein the apparatus comprises material suitable for beverage contact.

14. The kit of claim 13, wherein the apparatus comprises acetal.

15. The kit of claim 1, wherein the beverage redirecting apparatus is configured such that an angle between the first direction of fluid flow and the second direction of fluid flow is more than about 45°.

16. The kit of claim 15, wherein the angle between the first direction of fluid flow and the second direction of fluid flow is about 90°.

17. A beverage dispensing system installed at a beverage dispensing venue, the venue comprising a pre-existing countertop having a depth, the system comprising:

a handheld beverage dispensing head, configured and dimensioned to be held in a single hand of a user and further configured to receive user input from the single hand and to dispense at least one beverage from at least one pressurized beverage source in response to the input;

at least one beverage tube, comprising a downstream end that is fluidly connected to the beverage dispensing head and an upstream end;

a tube collector, wherein the tube collector houses an upstream portion of the beverage tube therein;

at least one flow control module;

at least one secondary tube, comprising an upstream end configured for attachment to and fluid communication with the beverage source, a downstream end attached to and in fluid communication with the flow control module, and a substantially straight portion near the downstream end thereof defined by a rigidity of a material of the tube; and a beverage redirecting apparatus disposed between the flow control module and the upstream end of the beverage tube, comprising at least one fluid inlet in fluid communication with the flow control module and at least one fluid outlet in fluid communication with the upstream end of the beverage tube, wherein the beverage redirecting apparatus is configured such that a first direction of fluid flow at the inlet is different from a second direction of fluid flow at the outlet;

wherein the beverage redirecting apparatus is attached between the flow control module and the second end of the beverage tube, such that the beverage flows through the secondary tube, then through the flow control module, then through the beverage redirecting apparatus, then into the beverage tube, and is then dispensed from the beverage dispensing head, wherein the tube collector and the beverage redirecting apparatus are mounted to the underside of the countertop extending along the countertop depth, and the flow control module and the straight portion are not mounted to the underside of the countertop extending along the countertop depth.

18. The beverage dispensing system of claim 17, further comprising the at least one pressurized beverage source;

wherein the upstream end of the secondary tube is attached to and in fluid communication with the beverage source.

19. The kit of claim 1, wherein the beverage redirecting apparatus further defines a fluid path extending from the inlet to the outlet, wherein the fluid path has exactly one bend which defines the difference between the first direction of fluid flow and the second direction of fluid flow.

20. The system of claim 17, wherein the tube collector has a tube collector length in a beverage flow direction, the flow control module has a flow control module length in the beverage flow direction, the straight portion has a straight portion length, and wherein the tube collector length plus the flow control module length plus the straight portion length is greater than the countertop depth.

21. A method of installing a beverage dispensing system at a beverage dispensing venue, the venue comprising a pre-existing countertop having a depth, the method comprising:

when an effective length is less than or equal to the countertop depth:

attaching a flow control module directly to an upstream end of a beverage tube; and mounting a tube collector, the flow control module, and a substantially straight portion of a secondary tube to an underside of the countertop to thereby extend along the countertop depth; and when the effective length is greater than the countertop depth:

attaching the flow control module to an inlet of a beverage redirecting apparatus;

attaching an outlet of the beverage redirecting apparatus to the upstream end of the beverage tube; and mounting the tube collector and the beverage redirecting apparatus to the underside of the countertop to thereby extend along the countertop depth, and not mounting the flow control module and the straight portion to the underside of the countertop extending along the countertop depth;

wherein the beverage tube comprises a downstream end fluidly connected to a handheld beverage dispensing head, an upstream end, and an upstream portion housed in the tube collector;

wherein the beverage dispensing head is configured and dimensioned to be held in a single hand of a user and further configured to receive user input from the single hand and to dispense at least one beverage from at least one pressurized beverage source in response to the input;

wherein the tube collector has a tube collector length in a beverage flow direction;

wherein the flow control module has a flow control module length in the beverage flow direction;

wherein the secondary tube comprises an upstream end attached to and in fluid communication with the beverage source, a downstream end attached to and in fluid communication with the flow control module, and the substantially straight portion, wherein the straight portion is near the downstream end of the secondary tube and is defined by a rigidity of a material of the tube, the straight portion having a straight portion length;

wherein the beverage redirecting apparatus is configured such that a first direction of fluid flow at the inlet is different from a second direction of fluid flow at the outlet;

wherein the effective length is defined as the tube collector length plus the flow control module length plus the straight portion length;

such that when the effective length is less than or equal to the countertop depth, the beverage redirecting apparatus is not included in the beverage dispensing system, such that the beverage flows from the pressurized beverage source through the secondary tube, then through the flow control module, then directly into the beverage tube, and is then dispensed from the beverage dispensing head; and when the effective length is greater than the countertop depth, the beverage redirecting apparatus is attached between the flow control module and the second end of the beverage tube, such that the beverage flows from the pressurized beverage source through the secondary tube, then through the flow control module, then through the beverage redirecting apparatus, then into the beverage tube, and is then dispensed from the beverage dispensing head.

* * * * *